US007495538B2

(12) United States Patent
Tsunemi et al.

(10) Patent No.: US 7,495,538 B2
(45) Date of Patent: Feb. 24, 2009

(54) INDUCTOR USING DRUM CORE AND METHOD FOR PRODUCING THE SAME

(75) Inventors: Masayoshi Tsunemi, Gunma (JP); Hideki Ogawa, Gunma (JP); Hidenori Aoki, Gunma (JP); Hideki Okada, Gunma (JP); Yoshikazu Okino, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 11/843,567

(22) Filed: Aug. 22, 2007

(65) Prior Publication Data

US 2008/0055034 A1 Mar. 6, 2008

(30) Foreign Application Priority Data

Aug. 25, 2006 (JP) ..... 2006-258014

(51) Int. Cl.
*H01F 27/36* (2006.01)

(52) U.S. Cl. ..... 336/84 M

(58) Field of Classification Search ..... 336/65, 336/83, 84 R, 84 M, 200, 206–208
See application file for complete search history.

(56) References Cited

U.S. PATENT DOCUMENTS 4,769,900 A * 9/1988 Morinaga et al. ..... 29/606
5,010,313 A * 4/1991 Kaneko et al. ..... 335/296
6,198,373 B1 * 3/2001 Ogawa et al. ..... 336/83
6,535,095 B2 * 3/2003 Aoki et al. ..... 336/83
6,727,792 B2 * 4/2004 Amada et al. ..... 336/192
7,358,843 B2 * 4/2008 Takayama et al. ..... 336/200

FOREIGN PATENT DOCUMENTS

JP 09-120926 5/1997
JP 10326711 A * 12/1998
JP 2001-185421 7/2001

* cited by examiner

*Primary Examiner*—Tuyen T. Nguyen
(74) *Attorney, Agent, or Firm*—Knobbe Martens Olson & Bear LLP

(57) ABSTRACT

An inductor comprises a drum core which comprises a sintered magnetic material and has a winding axis and a pair of collars in a plate shape provided on both ends of the winding axis. The inductor further comprises a coil conductor wound on the winding axis of the drum core, the coil conductor is covered on an outer periphery thereof with a composite magnetic material in a sheet form containing a resin and magnetic powder, and the composite magnetic material in a sheet form is adhered to the outer periphery of the coil conductor except at least for inner surfaces of the pair of collars of the drum core facing each other.

7 Claims, 7 Drawing Sheets

PRIOR ART

INDUCTOR USING DRUM CORE AND METHOD FOR PRODUCING THE SAME

BACKGROUND OF THE INVENTION

1. Field of the Invention

The present invention relates to an inductor used in various kinds of compact thin electronic equipments, and a method for producing the inductor, and more specifically, the invention relates to an inductor having a structure containing a coil conductor wound on a drum core and a composite magnetic material in a sheet form covering the outer periphery of the coil conductor, and a method for producing the inductor.

2. Description of Related Technology

An inductor using a drum core generally has a magnetic material covering an outer periphery of a coil conductor wound on the drum core in order to meet requirement on producing electronic equipments having a small size and a low profile. For example, JP-A-9-120926 proposes an inductor 110 shown in FIGS. 13A and 13B produced in such a manner that a coil wire 113 wound in a hollow shape is placed to straddle on a pair of lead frames 116*a* and 116*b*, a lead end and a tail end of the coil wire 113 are conductively connected to the lead frames 116*a* and 116*b*, respectively, and a magnetic powder molding material 111 containing magnetic powder and a resin is molded under pressure onto the periphery of the coil wire 113. JP-A-2001-185421 proposes a magnetic device 210 (220) shown in FIGS. 14A and 14B produced in such a manner that magnetic members 212*a*, 212*b* and 212*c* (222*a*, 222*b* and 222*c*) formed, for example, of a ferrite sintered body are placed in a drum form, a coil conductor 213 (223) is wound on the magnetic member 212*c* (222*c*) in a rod shape, and the members are embedded in a composite magnetic member 211 (221).

In recent years, there are increasing tendencies of decrease in size and thickness of electronic equipments. Accordingly, an inductor having a small size and a low profile is demanded for the electronic equipments. However, a composite magnetic material containing a resin and magnetic powder can provide an apparent magnetic permeability μ' of only about 10. Therefore, there is such a problem that the inductor 110 disclosed in JP-A-9-120926, in which the circumferences, including the inner circumference, of the wire coil 113 in a hollow shape are surrounded with the magnetic powder molding material 111 having a low magnetic permeability cannot provide a high inductance unless the number of turns of the wire coil is increased.

In the magnetic device 210 disclosed in JP-A-2001-185421, the composite magnetic member 211 containing a magnetic powder and a thermosetting resin is adhered to the magnetic member 212 corresponding to the collar of the drum core. Accordingly, a large residual stress remains inside the magnetic member 212 due to hardening of the resin contained in the magnetic member 211, so as to have such a problem that the apparent magnetic permeability μ' of the magnetic member 212 is decreased due to the presence of the residual stress to fail to provide a high inductance. Furthermore, there is another problem that a difference in linear expansion coefficient occurring between the composite magnetic member 211 and the magnetic member 212 formed, for example, of a ferrite sintered body induces cracks in the magnetic member 212 associated with an internal stress formed upon reflow soldering or a heat cycle test and the aforementioned residual stress.

SUMMARY OF CERTAIN INVENTIVE ASPECTS

Certain inventive aspects relate to an inductor using a drum core that provides a high inductance, and more specifically, to an inductor using a drum core that prevents formation of a residual stress, which arises from combination use of a composite magnetic material containing a resin and magnetic powder and a drum core formed of a sintered magnetic material, so as to suppress the inductance from being decreased.

A first inventive aspect relates to an inductor containing a drum core containing a sintered magnetic material and having a winding axis and a pair of collars in a plate shape provided on both ends of the winding axis, and a coil conductor wound on the winding axis of the drum core, the coil conductor being covered on an outer periphery thereof with a composite magnetic material in a sheet form containing a resin and magnetic powder, and the composite magnetic material in a sheet form is an inductor adhered to the outer periphery of the coil conductor except at least for inner surfaces of the pair of collars of the drum core facing each other.

According to the first aspect of the invention, even when the resin constituting the composite magnetic material or an adhesive for adhering the composite magnetic material undergoes contraction, a residual stress is suppressed from being formed at a portion where the collars and the winding axis are in contact with each other, to which a magnetic flux is most likely concentrated in the drum core.

According to the first aspect of the invention, furthermore, even when a difference in linear expansion coefficient occurs between the drum core formed of a sintered magnetic material and the composite magnetic material, an internal stress is suppressed from being formed upon reflow soldering or a heat cycle test at a portion where the collars and the winding axis are in contact with each other, to which a magnetic flux is most likely concentrated in the drum core formed of the sintered magnetic material.

Even when a residual stress, which arises from hardening of the resin constituting the composite magnetic material in a sheet form and/or the adhesive for adhering the composite magnetic material in a sheet form, is formed at a portion where the collars and the winding axis are in contact with each other, or even when a difference in linear expansion coefficient occurs between the drum core formed of a sintered magnetic material and the composite magnetic material, an internal stress is suppressed from being formed upon reflow soldering or a heat cycle test at a portion where the collars and the winding axis are in contact with each other, to which a magnetic flux is most likely concentrated in the drum core formed of the sintered magnetic material, whereby decrease in inductance of the inductor due to decrease in apparent magnetic permeability μ of the drum core formed of a sintered magnetic material is prevented from occurring, so as to provide such an inductor using a drum core that has a high inductance.

In a second inventive aspect, the inductor further contains an adhesive layer on one of major surfaces of the composite magnetic material in a sheet form, and the composite magnetic material in a sheet form is adhered to the outer periphery of the coil conductor with the adhesive layer.

According to the second aspect of the invention, a thermal impact and a mechanical impact applied externally are reduced by the adhesive layer to protect the drum core from the impacts.

A third aspect relates to a method for producing an inductor containing steps of: preparing a drum core containing a sintered magnetic material and having a winding axis and a pair of collars in a plate shape provided on both ends of the winding axis; winding a coil conductor on the winding axis of the drum core; and then adhering a composite magnetic material in a sheet form on an outer periphery of the coil conductor, while preventing the composite magnetic material in a sheet form from being in contact with inner surfaces of the pair of collars of the drum core facing each other.

According to the third aspect of the invention, a residual stress, which arises from contraction due to hardening of the resin contained in the composite magnetic material, is suppressed from being formed, so as to facilitate provision of such an inductor using a drum core that is suppressed from undergoing decrease in inductance thereof due to decrease in apparent magnetic permeability μ of the drum core.

A fourth inventive aspect relates to a method for producing an inductor containing steps of: preparing a drum core containing a sintered magnetic material and having a winding axis and a pair of collars in a plate shape provided on both ends of the winding axis; winding a coil conductor on the winding axis of the drum core; and then adhering a composite magnetic material in a sheet form on an outer periphery of the coil conductor, the composite magnetic material in a sheet form having an adhesive layer formed in advance on a selected area of one of major surfaces thereof except at least for an area where the composite magnetic material in a sheet form is in contact with inner surfaces of the pair of collars of the drum core facing each other.

According to the fourth aspect of the invention, the composite magnetic material in a sheet form is adhered to the outer periphery of the wound coil conductor without any special attention to prevent the composite magnetic material in a sheet form from being adhered to the inner surfaces of the collars facing each other, whereby such an inductor using a drum core can be provided that is suppressed from undergoing decrease in inductance thereof due to decrease in apparent magnetic permeability μ of the drum core.

DETAILED DESCRIPTION OF CERTAIN EMBODIMENTS

Figure 1A:
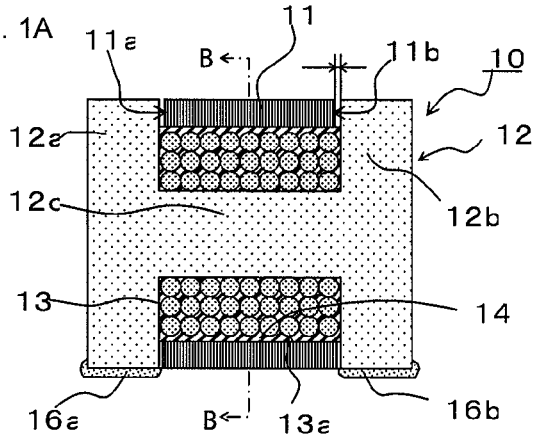
FIGS. 1A and 1B are cross sectional views showing an internal structure of an inductor using a drum core of a first embodiment of the invention.

According to the first aspect of the invention, the following advantages are obtained. The wound coil conductor is covered on an outer periphery thereof with the composite magnetic material in a sheet form containing a resin and magnetic powder, and the composite magnetic material in a sheet form is adhered to the outer periphery of the coil conductor except at least for inner surfaces of the pair of collars of the drum core facing each other, whereby even when the resin constituting the composite magnetic material or the adhesive for adhering the composite magnetic material undergoes contraction, a residual stress is suppressed from being formed at the portion where the collars and the winding axis are in contact with each other, to which a magnetic flux is most likely concentrated in the drum core.

Furthermore, the wound coil conductor is covered on an outer periphery thereof with the composite magnetic material in a sheet form containing a resin and magnetic powder, and the composite magnetic material in a sheet form is adhered to the outer periphery of the coil conductor except at least for inner surfaces of the pair of collars of the drum core facing each other, whereby even when a difference in linear expansion coefficient occurs between the drum core formed of a sintered magnetic material and the composite magnetic material, an internal stress is suppressed from being formed upon reflow soldering or a heat cycle test at a portion where the collars and the winding axis are in contact with each other, to which a magnetic flux is most likely concentrated in the drum core formed of the sintered magnetic material.

According to the second aspect of the invention, the following advantages are obtained. The composite magnetic material in a sheet form is adhered to the outer periphery of the coil conductor with the adhesive layer formed on one of major surfaces of the composite magnetic material in a sheet form, whereby a thermal impact and a mechanical impact applied externally are reduced by the adhesive layer to protect the drum core from the impacts.

According to the third aspect of the invention, the following advantages are obtained. A drum core containing a sintered magnetic material and having a winding axis and a pair of collars in a plate shape provided on both ends of the winding axis is prepared, a coil conductor is wound on the winding axis of the drum core, and then the composite magnetic material in a sheet form is adhered on the outer periphery of the coil conductor, while preventing the composite magnetic material in a sheet form from being in contact with inner surfaces of the pair of collars of the drum core facing each other, whereby provision of such an inductor using a drum core is facilitated that is suppressed from undergoing a residual stress, which arises from contraction due to hardening of the resin contained in the composite magnetic material.

According to the fourth aspect of the invention, the following advantages are obtained. A drum core containing a sintered magnetic material and having a winding axis and a pair of collars in a plate shape provided on both ends of the winding axis is prepared, a coil conductor is wound on the winding axis of the drum core, and then the composite magnetic material in a sheet form having an adhesive layer formed on a selected area of one of major surfaces thereof except at least for an area where the composite magnetic material in a sheet form is in contact with inner surfaces of the pair of collars of the drum core facing each other is adhered on the outer periphery of the coil conductor, whereby the composite magnetic material in a sheet form is adhered to the outer periphery of the wound coil conductor without any special attention to prevent the composite magnetic material in a sheet form from being adhered to the inner surfaces of the collars facing each other, whereby such an inductor using a drum core can be provided that is suppressed from undergoing decrease in inductance thereof due to decrease in apparent magnetic permeability μ of the drum core.

The aforementioned and other objects, constitutional features and advantages of the invention will be apparent from the following description and the attached drawings.

Figure 1B:
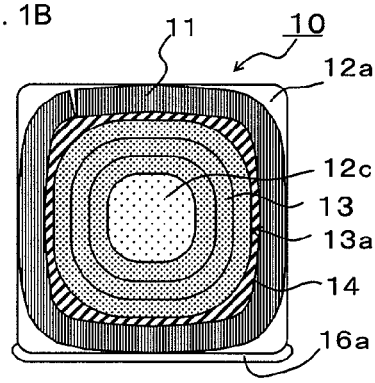
Figure 2C:
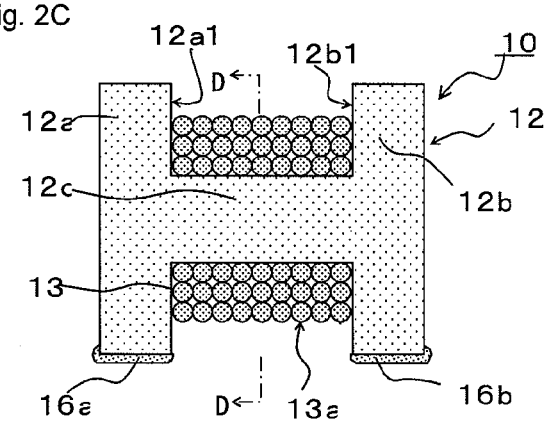
FIGS. 2C and 2D are cross sectional views showing the drum core used in the first embodiment having a winding wire wound on a winding axis of the drum core.
Figure 2D:
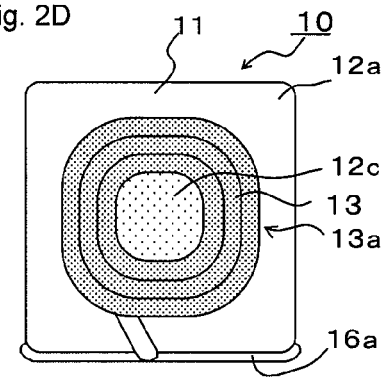
Figure 3:
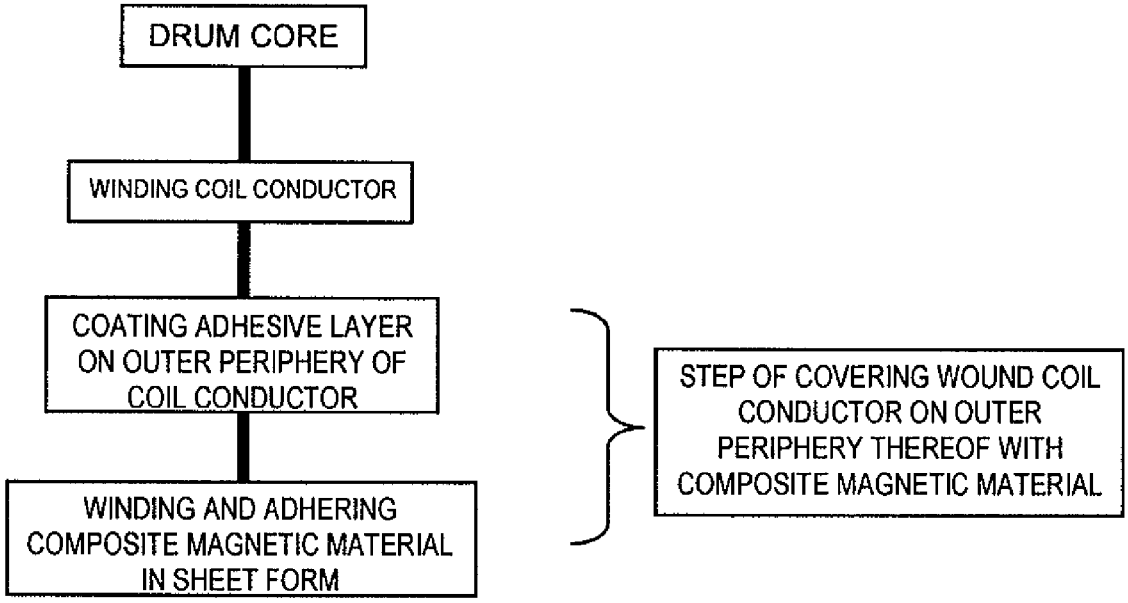
FIG. 3 is a flow chart showing an example of a method for producing the inductor using the drum core of the first embodiment.

An inductor using a drum core according to a first embodiment of the invention will be described with reference to FIGS. 1A, 1B, 2C, 2D and 3. FIGS. 1A and 1B are cross sectional views showing the internal structure of the inductor using a drum core of the first embodiment, in which FIG. 1A is a cross sectional view in the vertical direction on the center line of the winding axis of the drum core, and FIG. 1B is a cross sectional view in the vertical direction perpendicular to the winding axis. FIGS. 2C and 2D are cross sectional views showing the drum core used in the first embodiment having a winding wire wound on the winding axis of the drum core, in which FIG. 2C is a cross sectional view in the vertical direction on the center line of the winding axis of the drum core, and FIG. 2D is a cross sectional view in the vertical direction perpendicular to the winding axis. FIG. 3 is a flow chart showing an example of a method for producing the inductor using the drum core of the first embodiment.

As shown in FIGS. 1A, 1B, 2C and 2D, the inductor 10 using a drum core of the first embodiment has a drum core 12 containing a sintered magnetic material and having a winding axis 12*c* and a pair of collars 12*a* and 12*b* in a plate shape provided on both ends of the winding axis 12*c*, and a coil conductor 13 wound on the winding axis 12*c*.

The coil conductor 13 is covered on the outer periphery thereof with a composite magnetic material 11 in a sheet form containing a resin and magnetic powder, and the composite magnetic material 11 in a sheet form is adhered to the outer periphery 13*a* of the coil conductor 13 except at least for the inner surfaces 12*a*1 and 12*b*1 of the pair of collars 12*a* and 12*b* of the drum core 12 facing each other.

A preferred embodiment of the drum core 12 will be described. The drum core 12 may be formed of a sintered magnetic material, and preferred examples of the sintered magnetic material include an insulating ferrite, such as a Ni—Zn ferrite and a Ni—Zn—Cu ferrite, but the sintered magnetic material is not limited thereto, and other known sintered magnetic materials may be used.

A preferred embodiment of the coil conductor 13 will be described. The coil conductor 13 may be an insulation coated conductor wire, and preferred examples thereof include a polyurethane insulation coated copper wire and a polyester insulation coated copper wire, but the coil conductor 13 is not limited thereto, and other insulation coated wires may be used. A self-welding wire having a self-welding layer on the outer periphery of the insulation coated conductor wire may also be used.

A preferred embodiment of the composite magnetic material 11 will be described. The composite magnetic material may contain magnetic powder and a resin shown below. The composite magnetic material may further contain a coupling material or the like for improving the wettability between the magnetic powder and the resin depending on necessity.

In one embodiment, the composite magnetic material 11 may satisfy such properties that, at an addition amount of the filler including the magnetic powder and other inorganic fillers of about 70% by volume, the material is not broken on a 180° bending test, the glass transition temperature (Tg) is about 110° C. or less, the storage modulus of torsion G' is about $1\times10^8$ Pa or less (at the glass transition temperature or higher), and the breaking elongation is about 30% or more, and more preferably the material has rubber elasticity at ordinary temperature and has flexibility withstanding 180° bending at a large amount (for example, 92% by weight) the filler including the magnetic powder and other inorganic fillers. The composite magnetic material 11 preferably satisfies such heat resistance that the material withstands the reflow soldering temperature (e.g., 260° C.) and a heat cycle test temperature (from −55 to +1,251° C.).

A preferred embodiment of the magnetic powder used in the composite magnetic material 11 will be described. Examples of the magnetic powder include powder of sintered magnetic materials similar to the sintered magnetic material used in the drum core, and also include a Fe—Al—Si alloy (i.e., so-called Sendust) and other known magnetic metal powder.

A preferred embodiment of the resin used in the composite magnetic material 11 will be described. Preferred examples of the resin include resins having rubber elasticity obtained by adding a plasticizer, such as a phthalate ester, an adipate ester and an aliphatic dibasic acid ester, to synthetic rubber (such as chlorinated PE, EPDM, silicone rubber, fluorine rubber, epichlorohydrin rubber, acrylic rubber, nitrile rubber, EVA and polyisobutyrene rubber) or a thermosetting resin (such as a PPG-modified epoxy resin, a polysulfide-modified epoxy resin, a polyurethane resin, an acrylate resin and PVB).

A preferred embodiment of production of the composite magnetic material 11 in a sheet form will be described. The composite magnetic material 11 in a sheet form may be produced in such a manner that the magnetic powder and the resin are kneaded with a three-roll mill or the like and then molded into a sheet form by heat pressing, calendering or the like, or in alternative, a solvent is added to the magnetic powder and the resin to prepare a paste, which is coated to a sheet with a roll coater or the like, followed by molding into a sheet form by subjecting to heat pressing, calendering or the like. The composite magnetic material 11 in a sheet form preferably has a thickness of approximately from 5 to 500 μm and a variation R of the thickness thereof of about 20 μm or less. The composite magnetic material 11 in a sheet form preferably has a width that is equivalent to or less than the length of the winding axis 12*c* of the drum core 12, on which the coil conductor 13 is wound, and the gap between the inner surfaces 12*a*1 and 12*b*1 of the collars 12*a* and 12*b* of the drum core 12 and end surfaces 11*a* and 11*b* of the composite magnetic material 11 in a sheet form is preferably approximately from 0 to 170 μm.

A preferred embodiment of the adhesive 14 used for adhering the composite magnetic material 11 in a sheet form will be described. Preferred examples of the composition of the adhesive 14 include resins capable of exhibiting stickiness and adhesiveness upon application of heat and pressure, such as an epoxy resin, a nitrile resin, a silicone resin, an acrylate copolymer resin, a saturated or unsaturated polyester resin and a polyvinyl butyral resin. The adhesive 14 preferably satisfies such properties that the storage modulus of torsion is about $1\times10^8$ Pa or less (at 25° C.), and the residual stress of about 50 gf/mm$^2$ or less (at 25° C.).

The method for producing an inductor using a drum core according to one embodiment will be described. FIG. 3 is a flow chart showing a preferred embodiment of the method for producing the inductor using the drum core of the embodiment. A drum core 12 containing a sintered magnetic material is prepared, and a coil conductor 13 is wound on the winding axis 12*c* of the core 12. An adhesive 14 is coated on the outer periphery 13*a* of the wound coil conductor 13, and a composite magnetic material 11 in a sheet form is further wound thereon, followed by hardening the adhesive 14 to adhere the composite magnetic material 11 in a sheet form to the outer periphery 13*a* of the wound coil conductor 13. According to the procedure, the coil conductor 13 is covered on the outer periphery 13*a* thereof with the composite magnetic material 11.

Specifically, a drum core 12 containing a sintered magnetic material and having a winding axis 12*c* and a pair of collars 12*a* and 12*b* in a plate shape provided on both ends of the winding axis 12*c* is prepared, and a coil conductor 13 is wound on the winding axis 12*c* of the drum core 12. A composite magnetic material 11 in a sheet form is adhered on the outer periphery 13*a* of the coil conductor 13, while preventing the composite magnetic material 11 in a sheet form from being in contact with inner surfaces 12*a*1 and 12*b*1 of the pair of collars 12*a* and 12*b* of the drum core 12 facing each other.

The composite magnetic material 11 in a sheet form may have an adhesive 14 coated on one of the major surfaces thereof in advance, and the composite material 11 in a sheet form may be wound on the outer periphery 13*a* of the coil conductor 13 wound on the winding axis 12*c* of the drum core 12.

Furthermore, a resin that exerts self-welding property through fusion under heat may be used instead of the adhesive 14, and examples of the resin include a B-stage epoxy resin. The resin that exerts self-welding property may be molded into a sheet form and then wound on the outer periphery 13*a* of the coil conductor 13. A continuous sheet of the resin that exerts self-welding property, which is molded with an extrusion molding apparatus or the like, may be wound in advance on the outer periphery 13*a* of the coil conductor 13. Furthermore, the resin that exerts self-welding property may be formed as an adhesive layer on one of the major surfaces of the composite magnetic material 11 in a sheet form, and the composite magnetic material 11 in a sheet form may be wound on the outer periphery 13*a* of the coil conductor 13, followed by welding under heat.

EXAMPLE

Preparation of Drum Core:

20 pieces of drum cores were prepared, each of which was formed of a Ni—Zn ferrite sintered magnetic material and had collars having an outer dimension of 1.2 mm×1.2 mm provided on both ends of a winding axis and a length in the winding axis direction of 2.0 mm.

Formation of Electrodes:

A baking type Ag paste was coated on the end surfaces of the collars, followed by baking at a prescribed temperature, to form a pair of electrodes for conductively connecting to the lead end and the tail end of the coil conductor.

Winding of Coil Conductor:

A polyurethane insulation coated copper wire having a diameter of 75 μm was wound 39 turns on a resulting drum core, and both ends of the coil conductor were conductively connected to the electrodes under heat and pressure.

Preparation of Composite Magnetic Material in Sheet Form (Composite Magnetic Material Sheet):

DMP (dimethyl phthalate) as a plasticizer was added to styrene-butadiene rubber, followed by kneading, to which PO (peroxide) was added as a crosslinking agent, and 70% by volume of flat Sendust powder as magnetic powder was added. The mixture was then kneaded with mixing rolls and molded by hot press, followed by curing through vulcanization, to obtain a composite magnetic material in a sheet form having a thickness of 150 μm. An acrylate copolymer resin was coated on one of the major surfaces of the composite magnetic material in a sheet form to a thickness of 10 μm as an adhesive layer, which is then dried and post-cured to obtain a composite magnetic material sheet for an inductor using a drum core.

Winding of Composite Magnetic Material in Sheet Form:

The composite magnetic material in a sheet form, which has been cut to a prescribed width to make a gap to the inner surface of the collar of the drum core of 10 μm, was wound one turn on the outer periphery of the coil conductor wound on the winding axis of the drum core, followed by adhering.

Comparative Example

Instead of the aforementioned composite magnetic material, a composite magnetic material in a sheet form having a width providing no gap to the inner surface of the collar of the drum core was wound one turn on the winding axis of the drum core, followed by adhering.

10 test samples of each of the inductors of one embodiment and the comparative example were measured for inductance with an LCR meter (Model HP4285A, produced by Agilent Technologies). As a result, the samples having the composite magnetic material in a sheet for wound with a gap to the inner surface of the drum core had an average value of inductance of about 8.5 μH, but the samples having the composite magnetic material in a sheet form wound with no gap to the inner surface of the drum core as the comparative example had an average value of inductance of about 7.6 μH, which confirmed that the embodiment, in which the composite magnetic material in a sheet form was wound with a gap, was improved in inductance by 12% as compared to the comparative example, in which the composite magnetic material in a sheet form was wound with no gap.

In the inductor using a drum core according to the first embodiment of the invention, the coil conductor 13 is covered on the outer periphery 13*a* thereof with the composite magnetic material 11 in a sheet form, and the composite magnetic material 11 in a sheet form is adhered to the outer periphery 13*a* of the coil conductor 13 except at least for the inner surfaces 12*a*1 and 12*b*1 of the pair of collars 12*a* and 12*b* of the drum core 12 facing each other, whereby a residual stress is suppressed from being formed in the drum core 12 to obtain a higher inductance than the conventional embodiments.

Figure 4:
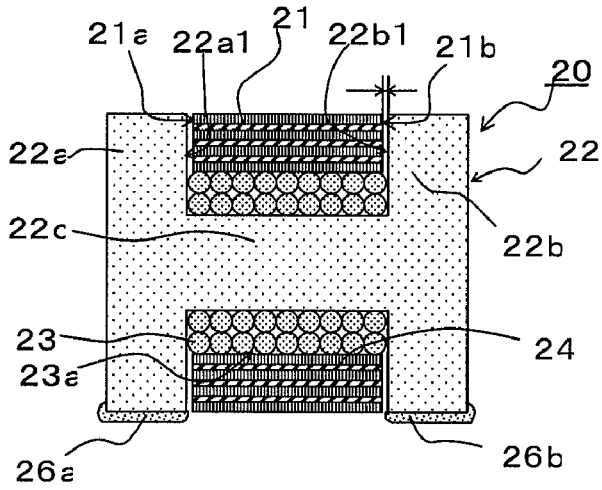
FIG. 4 is a cross sectional view showing an internal structure of an inductor using a drum core of a second embodiment of the invention.
Figure 5:
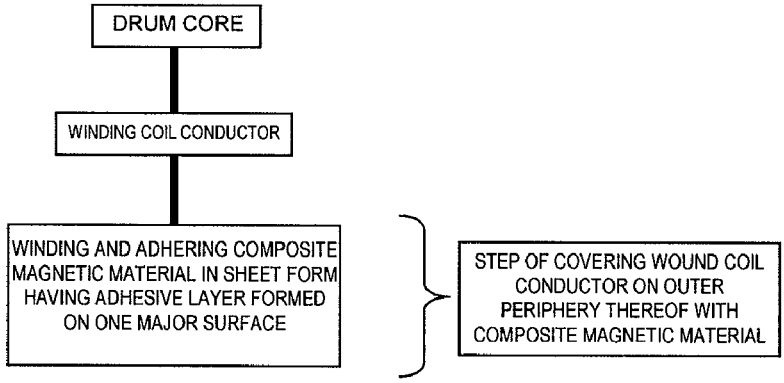
FIG. 5 is a flow chart showing an example of a method for producing the inductor using the drum core of the second embodiment.
Figure 6:
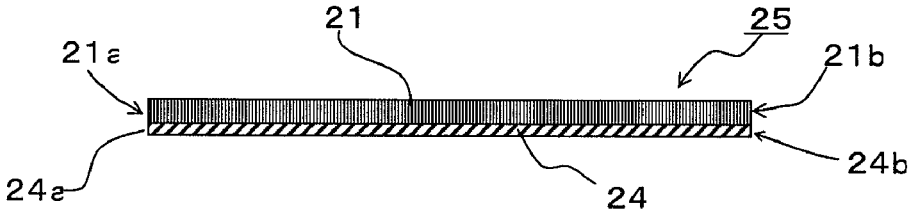
FIG. 6 is a cross sectional view showing an example of a composite magnetic material sheet used in the inductor using the drum core of the second embodiment.

An inductor using a drum core according to a second embodiment of the invention will be described with reference to FIGS. 4, 5 and 6. FIG. 4 is a cross sectional view showing the internal structure of the inductor 20 using a drum core of the second embodiment, in which FIG. 4A is a cross sectional view in the vertical direction on the center line of the winding axis 22*c* of the drum core 22, and FIG. 4B is a cross sectional view in the vertical direction perpendicular to the winding axis 22*c*. FIG. 5 is a flow chart showing an example of a method for producing the inductor 20 using the drum core of the second embodiment. FIG. 6 is a cross sectional view showing an example of a composite magnetic material sheet 25 used in the inductor 20 using the drum core of the second embodiment.

As shown in FIG. 4, the inductor 20 using a drum core of the second embodiment has a drum core 22 containing a sintered magnetic material and having a winding axis 22*c* and a pair of collars 22*a* and 22*b* in a plate shape provided on both ends of the winding axis 22*c*, and a coil conductor 23 wound on the winding axis 22*c*. The coil conductor 23 is covered on the outer periphery 23*a* thereof with a composite magnetic material 21 in a sheet form containing a resin and magnetic powder, and the composite magnetic material 21 in a sheet form is adhered to the outer periphery 23*a* of the coil conductor 23 except at least for the inner surfaces 22*a*1 and 22*b*1 of the pair of collars 22*a* and 22*b* of the drum core 22 facing each other.

In the inductor 20 having a drum core of the second embodiment, the composite magnetic material 21 in a sheet form contains a composite magnetic material sheet 25 having an adhesive layer 24 on one of the major surfaces thereof, and is adhered to the outer periphery 23*a* of the coil conductor 23.

More specifically, the adhesive layer 24 is formed on one of the major surfaces of the composite magnetic material 21 in a sheet form in advance to constitute the composite magnetic material sheet 25, and the composite magnetic material sheet 25 is wound four turns on the outer periphery of the coil conductor 23 and adhered thereto with the adhesive layer 24.

The difference between the second embodiment and the first embodiment resides in that in the inductor of the second embodiment, the adhesive layer 24 is formed on one of the major surfaces of the composite magnetic material 21 in a sheet form to constitute composite magnetic material sheet 25, which has a smaller thickness than the composite magnetic material 11 used in the first embodiment. In the second embodiment, furthermore, the composite magnetic material sheet 25 is wound four turns on the outer periphery of the coil conductor 23 wound on the winding axis of the drum core, and adhered thereto. As shown in FIG. 6, moreover, the composite magnetic material sheet 25 used in the second embodiment has the composite magnetic material 21 in a sheet form and the adhesive layer 24 that have the same width, and as similar to the first embodiment, the composite magnetic material sheet 25 is cut to a prescribed width to provide a gap to the inner surfaces 22*a*1 and 22*b*1 of the collars 22*a* and 22*b* of the drum core 22, by which the composite magnetic material sheet 25 is prevented from being in contact with the inner surfaces 22*a*1 and 22*b*1, and wound and adhered to the outer periphery 23*a* of the wound coil conductor 23.

A preferred embodiment of the adhesive layer 24 formed on one of the major surfaces of the composite magnetic material 21 in a sheet form will be described. Preferred examples of the composition of the adhesive layer 24 include resins capable of exhibiting stickiness and adhesiveness upon application of heat and pressure, such as an epoxy resin, a nitrile resin, a silicone resin, an acrylate copolymer resin, a saturated or unsaturated polyester resin and a polyvinyl butyral resin. The adhesive agent 14 preferably satisfies such properties that the storage modulus of torsion is about $1\times10^8$ Pa or less (at 25° C.), and the residual stress of about 50 gf/mm$^2$ or less (at 25° C.).

The term "stickiness and adhesiveness" herein means a pressure-sensitive (tacking) adhesion mechanism, in which tackiness is exhibited upon contact, and a large adhesion force is exhibited upon breakage.

A preferred embodiment of the composite magnetic material sheet 25 containing the composite magnetic material 21 in a sheet form having the adhesive layer 24 on one of the major surfaces thereof in advance will be described. The adhesive layer 24 preferably has a thickness of approximately from 5 to 100 μm. The adhesive layer 24 preferably has a width of approximately from 50 to 100% of the width of the composite magnetic material 21 in a sheet form. In the case where the width of the adhesive layer 24 is smaller than the width of the composite magnetic material 21 in a sheet form, the adhesive layer 24 may be formed continuously in a strip form on the center of the composite magnetic material 21 in a sheet form, whereby the composite magnetic material 21 in a sheet form can be prevented from being adhered to the inner surfaces 22*a*1 and 22*b*1 of the collars 22*a* and 22*b* of the drum core 22 even when there is no gap or only a significantly small gap between the end surfaces 21*a* and 21*b* of the composite magnetic material 21 in a sheet form and the inner surfaces 22*a*1 and 22*b*1 of the collars 22*a* and 22*b* of the drum core 22. The adhesive layer 24 can be easily formed in one strip shape along the lengthwise direction of the composite magnetic material 21 in a sheet form, but the adhesive layer 24 is not limited to that shape and may be formed as plural strips divided in the widthwise direction. A depressed portion continuing in a groove shape may be formed on the surface of the composite magnetic material 21 in a sheet form, and the whole or partial thickness of the adhesive layer may be housed in the depressed portion. The adhesive layer may be formed as being scattered as plural dots in the whole or partial area in the width direction, and may also be formed as being divided in the lengthwise direction of the composite magnetic material in a sheet form.

The method for producing an inductor using a drum core according to the second embodiment of the invention will be described with reference to FIG. 5. In the method for producing an inductor having a drum core according to the embodiment, a drum core 22 containing a sintered magnetic material and having a winding axis 22*c* and a pair of collars 22*a* and 22*b* in a plate shape provided on both ends of the winding axis 22*c* is prepared, and a coil conductor 23 is wound on the winding axis 22*c* of the drum core 22. A composite magnetic material sheet 25 having an adhesive layer 24 formed on one of the major surfaces thereof is adhered on the outer periphery 23*a* of the coil conductor 23, while preventing the composite magnetic material sheet 25 from being in contact with inner surfaces 22*a*1 and 22*b*1 of the pair of collars 22*a* and 22*b* of the drum core 22 facing each other.

Figure 7:
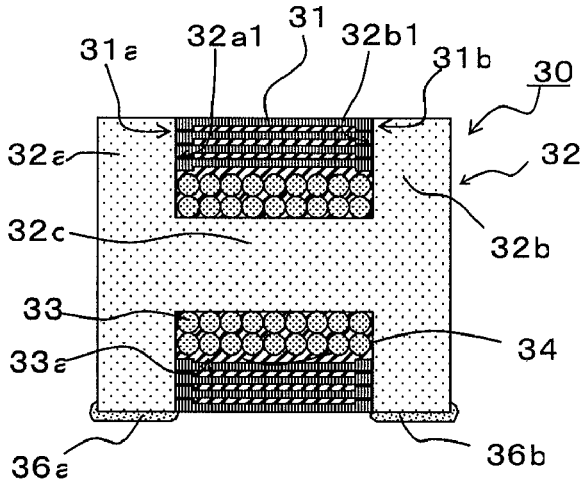
FIG. 7 is a cross sectional view showing an internal structure of an inductor using a drum core of a third embodiment of the invention.
Figure 8:
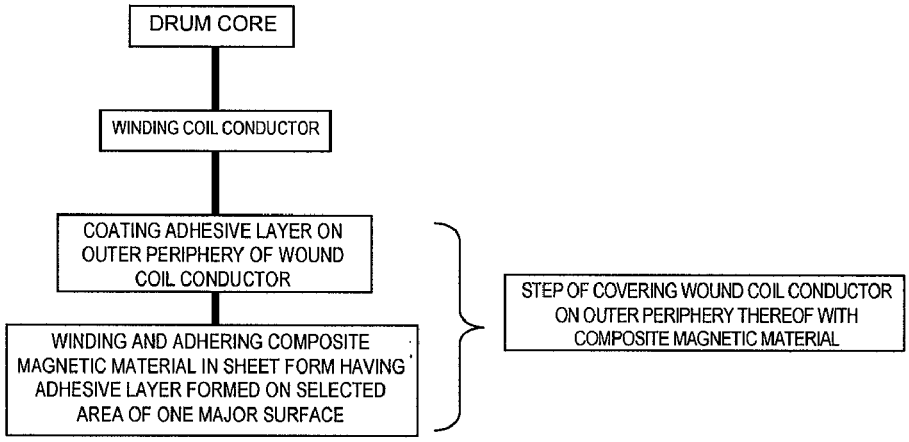
FIG. 8 is a flow chart showing an example of a method for producing the inductor using the drum core of the third embodiment.
Figure 9:
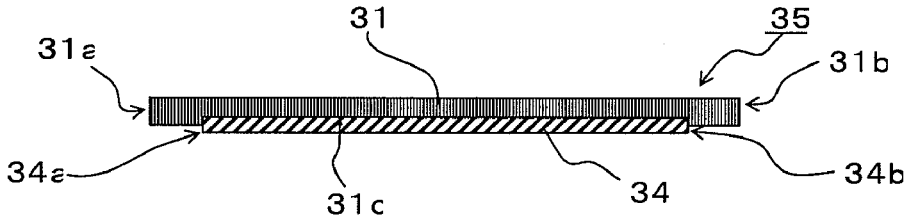
FIG. 9 is a cross sectional view showing an example of a composite magnetic material sheet used in the inductor using the drum core of the third embodiment.

An inductor using a drum core according to a third embodiment of the invention will be described with reference to FIGS. 7, 8 and 9. FIG. 7 is a diagram showing the internal structure of the inductor 30 using a drum core of the third embodiment, which is a cross sectional view in the vertical direction on the center line of the winding axis 32*c* of the drum core 32. FIG. 8 is a flow chart showing an example of a method for producing the inductor 30 using the drum core of the third embodiment. FIG. 9 is a cross sectional view showing an example of a composite magnetic material sheet 35 used in the inductor 30 using the drum core of the third embodiment.

As shown in FIG. 7, the inductor 30 using a drum core of the third embodiment has a drum core 32 containing a sintered magnetic material and having a winding axis 32*c* and a pair of collars 32*a* and 32*b* in a plate shape provided on both ends of the winding axis 32*c*, and a coil conductor 33 wound on the winding axis 32*c* of the drum core 32. The coil conductor 33 is covered on the outer periphery 33*a* thereof with a composite magnetic material 31 in a sheet form containing a resin and magnetic powder, and the composite magnetic material 31 in a sheet form is adhered to the outer periphery 33*a* of the coil conductor 33 except at least for the inner surfaces 32*a*1 and 32*b*1 of the pair of collars 32*a* and 32*b* of the drum core 32 facing each other.

More specifically, the adhesive layer 34 is formed on one of the major surfaces of the composite magnetic material 31 in a sheet form to constitute the composite magnetic material sheet 35, and the composite magnetic material sheet 35 is wound four turns on the outer periphery 33*a* of the coil conductor 33 and adhered thereto with the adhesive layer 34.

The difference between the third embodiment and the second embodiment resides in that as shown in FIG. 9, the composite magnetic material 31 in a sheet form used in the inductor using a drum core of the third embodiment is provided with a depressed portion 31*c* having a large width on a selected area of one of the major surfaces thereof, and the adhesive layer 34 is formed to make the partial thickness thereof be housed in the depressed portion 31*c*, so as to constitute the composite magnetic material sheet 35, which has a smaller thickness than the composite magnetic material sheet 25 used in the second embodiment. In the third embodiment, as shown in FIG. 9, the adhesive layer 34 is formed only on the selected area of one of the major surfaces of the composite magnetic material 31 in a sheet form with the end surfaces 34*a* and 34*b* of the adhesive layer 34 being positioned inside the end surfaces 31*a* and 31*b* in the width direction of the composite magnetic material 31 in a sheet form, whereby the end surfaces 31*a* and 31*b* of the composite magnetic material 31 in a sheet form are prevented from being adhered to the inner surfaces 32*a*1 and 32*b*1 of the collars 32*a* and 32*b* of the drum core 32 even when the composite magnetic material sheet 35 is wound and adhered to the outer periphery 33*a* of the wound coil conductor 33 with the end surfaces 31*a* and 31*b* of the composite magnetic material 31 in a sheet form being substantially in contact with the inner surfaces 32*a*1 and 32*b*1 of the collars 32*a* and 32*b* of the drum core 32 with no gap.

In the method for producing an inductor 30 using a drum core according to the third embodiment, a drum core 32 containing a sintered magnetic material and having a winding axis 32*c* and a pair of collars 32*a* and 32*b* in a plate shape provided on both ends of the winding axis 32*c* is prepared, and a coil conductor 33 is wound on the winding axis 32*c* of the drum core 32. A composite magnetic material 31 in a sheet form having an adhesive layer 34 formed on one of the major surfaces thereof on a selected area except at least for an area in contact with inner surfaces 32*a*1 and 32*b*1 of the pair of collars 32*a* and 32*b* of the drum core 32 facing each other.

A composite magnetic material sheet 35 having the adhesive layer 34 on the selected area of one of the major surfaces is used as the composite magnetic material 31 in a sheet form.

Figure 10:
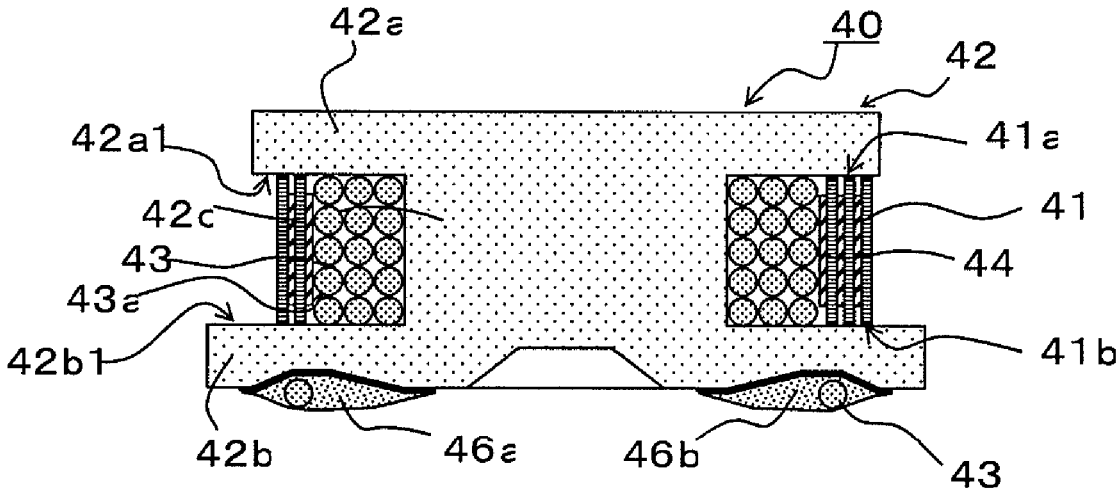
FIG. 10 is a cross sectional view showing an internal structure of an inductor using a drum core of a fourth embodiment of the invention.

An inductor using a drum core according to a fourth embodiment and other modified embodiments of the invention will be described with reference to FIGS. 10 and 11A to 11D. FIG. 10 is a diagram showing the internal structure of the inductor 40 using a drum core of the fourth embodiment, which is a cross sectional view in the vertical direction on the center line of the winding axis 42*c* of the drum core 42. FIGS. 11A to 11D are cross sectional view showing an example and modified examples of the composite magnetic material sheet used in the inductor using the drum core of the fourth embodiment.

As shown in FIG. 10, the inductor 40 using a drum core of the fourth embodiment has a drum core 42 containing a sintered magnetic material and having a winding axis 42*c* and a pair of collars 42*a* and 42*b* in a plate shape provided on both ends of the winding axis 42*c*, and a coil conductor 43 wound on the winding axis 42*c* of the drum core 42. In the inductor 40 using drum core, the coil conductor 43 is covered on the outer periphery 43*a* thereof with a composite magnetic material 41 in a sheet form containing a resin and magnetic powder, and the composite magnetic material 41 in a sheet form is adhered to the outer periphery 43*a* of the coil conductor 43 except at least for the inner surfaces 42*a*1 and 42*b*1 of the pair of collars 42*a* and 42*b* of the drum core 42 facing each other.

In the inductor 40 using drum core, the composite magnetic material 41 in a sheet form has an adhesive layer 44 formed on one of the major surfaces thereof, and is adhered to the outer periphery 43*a* of the coil conductor 43 with the adhesive layer 44.

More specifically, the inductor 40 using drum core has the vertical drum core 42 having the winding axis 42*c* disposed vertically with respect to the mounting surface, the coil conductor 43 wound on the winding axis 42*c* of the core 42, and the composite magnetic material 41 in a sheet form wound, e.g., 2.4 turns on the outer periphery 43*a* of the coil conductor 43 and adhered thereto with the adhesive layer 44.

Figure 11A:
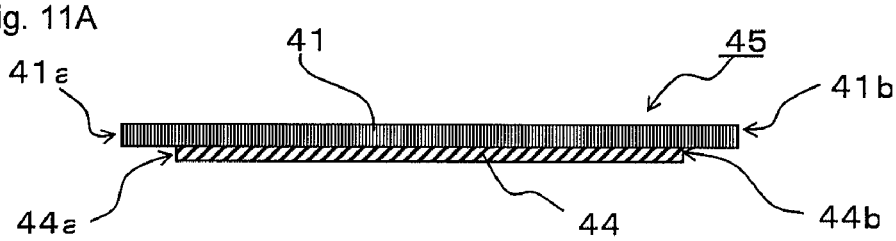
FIGS. 11A to 11D are cross sectional views showing an example and modified examples of a composite magnetic material sheet used in the inductor using the drum core of the fourth embodiment.

The difference between the fourth embodiment and the third embodiment resides in that the composite magnetic material 41 in a sheet form used in the inductor 40 using a drum core of the fourth embodiment does not have a depressed portion, which appears in the third embodiment, but the adhesive layer 44 is formed on the flat major surface to constitute the composite magnetic material sheet 45, which is wound 2.4 turns and adhered to the outer periphery of the wound coil conductor. In the fourth embodiment, as shown in FIG. 11A, the adhesive layer 44 is formed only on the selected area of one of the major surfaces of the composite magnetic material 41 in a sheet form, whereby the end surfaces 41*a* and 41*b* of the composite magnetic material 41 in a sheet form are prevented from being adhered to the inner surfaces 42*a*1 and 42*b*1 of the collars 42*a* and 42*b* of the drum core 42 even when the composite magnetic material sheet 45 is wound and adhered to the outer periphery 43*a* of the wound coil conductor 43 with the end surfaces 41*a* and 41*b* of the composite magnetic material 41 in a sheet form being substantially in contact with the inner surfaces 42*a*1 and 42*b*1 of the collars 42*a* and 42*b* of the drum core 42 with no gap.

In the fourth embodiment, a vertical drum core is used, and therefore, the portion where the composite magnetic material in a sheet form is wound and adhered thereon is in an area that exerts no influence on suction holding and positioning of an electronic device when the electronic device is mounted on a circuit board by using an automatic electronic device mounting machine, whereby the winding amount of the composite magnetic material in a sheet form can be arbitrarily controlled. Accordingly, an inductor using a drum core having an arbitrary inductance can be easily produced without variation factors including a residual stress and an internal stress, and thus such an inductor using a drum core can be provided that has a smaller tolerance in inductance than the conventional products.

EXAMPLE

Preparation of Drum Core:

40 pieces of drum cores were prepared, each of which was formed of a Ni—Zn ferrite sintered magnetic material and had collars having an outer dimension of 1.8 mm×1.8 mm provided on both ends of a winding axis and a length in the winding axis direction of 2.5 mm.

Formation of Electrodes:

A baking type Ag paste was coated on the end surfaces of the collars, followed by baking at a prescribed temperature, to form a pair of electrodes for conductively connecting to the lead end and the tail end of the coil conductor.

Winding of Coil Conductor:

A polyurethane insulation coated copper wire having a diameter of 75 μm was wound 30 turns on a resulting drum core, and both ends of the coil conductor were conductively connected to the electrodes under heat and pressure.

A composite magnetic material in a sheet form having a thickness of 50 μm was obtained in the example of the first embodiment. An acrylate copolymer resin was coated on one of the major surfaces of the composite magnetic material in a sheet form to a thickness of 10 μm as an adhesive layer to obtain a composite magnetic material sheet for an inductor using a drum core.

Winding of Composite Magnetic Material in Sheet Form:

The composite magnetic material in a sheet form was wound 1.4 turns, 2.4 turns, 3.4 turns or 4.4 turns on the outer periphery of the coil conductor wound on the winding axis of the drum core with a gap to the inner surface of the collar of the drum core of 10 μm, followed by adhering, to prepare 10 pieces of samples for each numbers of turns.

10 test samples of each of the inductors were measured for inductance with an LCR meter (Model HP4285A, produced by Agilent Technologies). As a result, the conductors had an average value of inductance for 10 samples of 8.4 μH for 1.4 turns of the composite magnetic material in a sheet form, 9.9 μH for 2.4 turns, 11.3 μH for 3.4 turns, and 12.6 μH for 4.4 turns, which confirmed that the inductance of the surface-mounting inductor was increased by increasing the number of turns of the composite magnetic material in a sheet form.

Figure 11B:
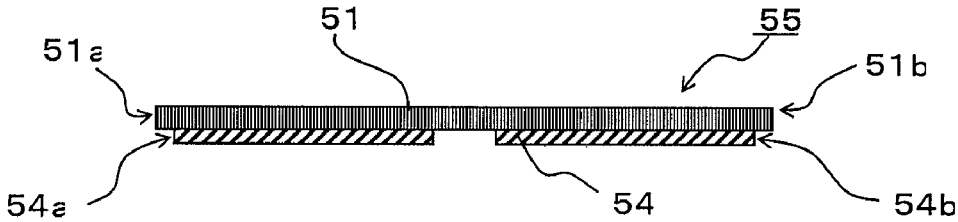
Figure 11C:
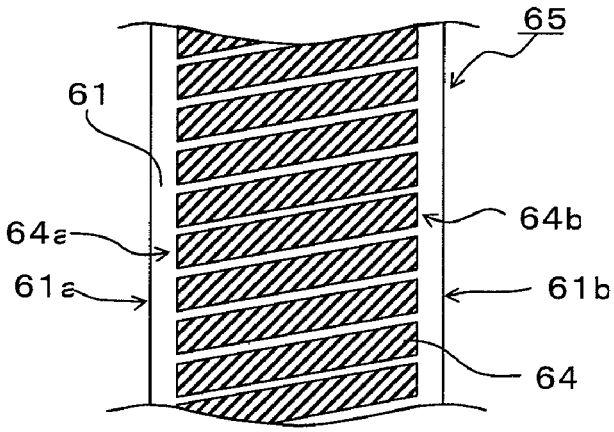
Figure 11D:
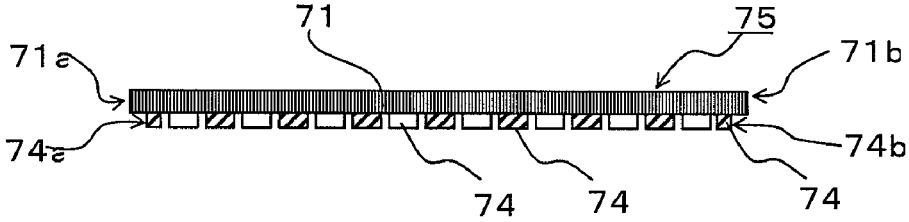

Modified examples of the composite magnetic material sheet used in the inductor using a drum core will be described with reference to FIGS. 11B to 11D. The composite magnetic material sheets used in the aforementioned embodiments have an adhesive layer formed in one strip shape along the lengthwise direction of the composite magnetic material. The invention is not limited to them, but the adhesive layer 54 may be formed as plural strips divided in the widthwise direction of the composite magnetic material 51 in a sheet form as shown in FIG. 11B, and the adhesive layer 64 may also be formed as being divided in the lengthwise direction of the composite magnetic material 61 in a sheet form as shown in FIG. 11C. Furthermore, the adhesive layer may be formed as being scattered as plural dots 74*a* to 74*c* in the whole or partial area in the width direction of the composite magnetic material 71 in a sheet form as shown in FIG. 11D.

In the inductor using a drum core according to the embodiments of the invention, the coil conductor is covered on the outer periphery thereof with the composite magnetic material having been formed into a sheet form by winding and adhering, whereby the coil conductor can be covered without adhering to the inner surfaces of the collars of the drum core by controlling the width of the composite magnetic material in a sheet form and the width of the adhesive layer.

While not shown in the figures, the width of the composite magnetic material in a sheet form and/or the width of the adhesive layer may be changed along the lengthwise direction. For example, the width of the composite magnetic material in a sheet form and/or the width of the adhesive layer may be gradually decreased by approaching toward the tail end in the lengthwise direction of the composite magnetic material in a sheet form. According to the configuration, the composite magnetic material in a sheet form can be prevented from being adhered erroneously to the inner surfaces of the collars of the drum core.

In the inductor using a drum core according to the embodiments of the invention, the coil conductor is covered on the outer periphery thereof with the composite magnetic material having been formed into a sheet form by winding and adhering, whereby the filling ratio of the magnetic powder and other fillers added to the composite magnetic material can be increased to reduce the content of the resin in the composite magnetic material, as compared to the conventional cases where a composite magnetic material is directly molded on the outer periphery of the wound coil conductor by an injection molding method, a paste coating method or the like. Accordingly, the residual stress can be reduced from this point of view. Specifically, the content of the filler of the composite magnetic material having been formed into a sheet form can be increased to about 92% by weight whereas the content of the filler in the conventional paste coating method is about 82% by weight at most. According to the configuration, more specifically, in the case where Ni—Zn ferrite powder having a particle diameter of from 1 to 100 μm with D50% of 20 μm is used as the filler, the apparent magnetic permeability μ' of the composite magnetic material, which has been conventionally 7, is increased to 12, i.e., improved by 71%. In the case where flat Sendust powder having a particle diameter of from 10 to 100 μm is used, the apparent magnetic permeability μ' of the composite magnetic material, which has been conventionally 22, is increased to 52, i.e., improved by 136%.

Furthermore, the apparent magnetic permeability μ' of the composite magnetic material can be increased by increasing the content of the filler, whereby an inductance equivalent to the conventional products can be obtained when the number of turns of the coil conductor wound on the drum core, and thus the equivalent series resistance Rdc of the coil can be decreased by reducing the length of the coil conductor as compared to the conventional products. Specifically, in the case where the flat Sendust powder having a particle diameter of from 10 to 100 μm is used, the apparent magnetic permeability μ' of the composite magnetic material, which has been conventionally 22, is increased to 52 to reduce Rdc by 34%.

In the inductor using a drum core according to the embodiments of the invention, the coil conductor is covered on the outer periphery thereof with the composite magnetic material having been formed into a sheet form by winding and adhering, whereby a target inductance value can be obtained with less variation by controlling the volume of the composite magnetic material covering the coil conductor through selection of the number of turns of the composite magnetic material in a sheet form. Specifically, in the case where the apparent magnetic permeability μ' of the composite magnetic material is 22 by using flat Sendust powder having a particle diameter of from 10 to 100 μm, the variation of inductance, which has been ±5% by the conventional paste coating method, can be reduced to ±1% in one embodiment.

While a composite magnetic material sheet having an adhesive layer on a selected area on one of major surfaces of a composite magnetic material in a sheet form is used in the third and fourth embodiments, the embodiments are not limited thereto, and various changes and modifications may be made therein.

Figure 12:
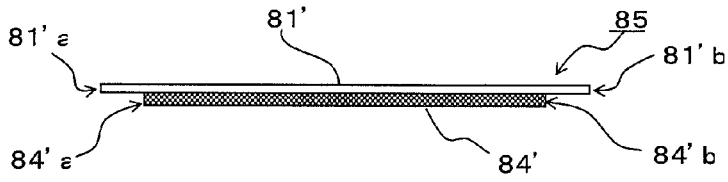
FIG. 12 is a cross sectional view showing a modified example of a composite magnetic material sheet used in an inductor using a drum core of one embodiment.
Figure 13A:
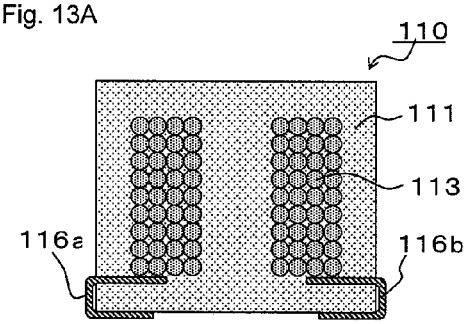
FIGS. 13A and 13B are cross sectional views showing an example of the related art.
Figure 13B:
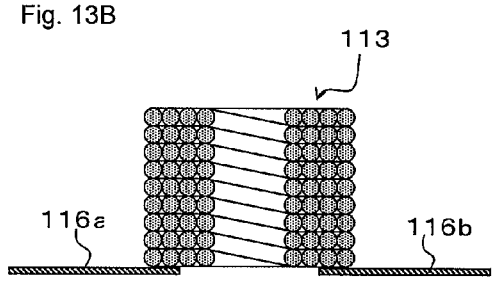
PRIOR ART Fig. 13B
Figure 14A:
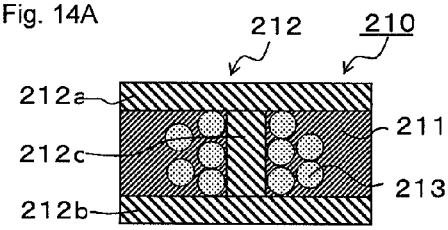
PRIOR ART Fig. 14A
FIGS. 14A and 14B are cross sectional views showing another example of the related art.
Figure 14B:
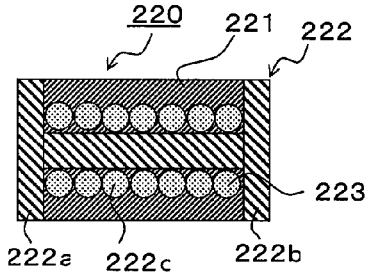
PRIOR ART Fig. 14B

Another modified example of the composite magnetic material sheet used in the inductor using a drum core will be described with reference to FIG. 12. FIG. 12 is a cross sectional view showing the modified example of the composite magnetic material sheet. As shown in FIG. 12, the composite magnetic material sheet 85 of the modified example has an insulating substrate 81' in a sheet form having on a selected area of one of major surfaces thereof a composite magnetic and adhesive layer 84' containing a resin having self-welding property and magnetic powder, and can be used in the aforementioned embodiments instead of the composite magnetic material sheets. According to the configuration, the composite magnetic and adhesive layer 84' can be prevented from being adhered to the inner surfaces of the collars of the drum core even when there is no gap or only a significantly small gap between the end surfaces 81'*a* and 81'*b* of the insulating substrate 81' in a sheet form and the inner surfaces of the collars of the drum core.

In the case where there is no gap or only a significantly small gap between the end surface 81'*a* or 81'*b* of the insulating substrate 81' in a sheet form and one of the inner surfaces of the collars of the drum core, the composite magnetic and adhesive layer 84' can be disposed at a target position on the outer periphery of the coil conductor wound on the winding axis of the drum core even when the width of the composite magnetic and adhesive layer 84' is small as compared to the distance between the inner surfaces of the collars of the drum core facing each other, whereby the inductance of the inductor can be prevented from undergoing variation due to fluctuation in position of the composite magnetic and adhesive layer.

The inductance of the inductor can be controlled by controlling the position where the composite magnetic and adhesive layer disposed on the outer periphery of the coil conductor wound on the winding axis of the drum core.

According to certain embodiments, an inductor using a drum core used in various kinds of compact thin electronic equipments can be favorably produced.

The foregoing description details certain embodiments of the invention. It will be appreciated, however, that no matter how detailed the foregoing appears in text, the invention may be practiced in many ways. It should be noted that the use of particular terminology when describing certain features or aspects of the invention should not by itself be taken to imply that the terminology is being re-defined herein to be restricted to including any specific characteristics of the features or aspects of the invention with which that terminology is associated.

While the above detailed description has shown, described, and pointed out novel features of the invention as applied to various embodiments, it will be understood that various omissions, substitutions, and changes in the form and details of the device or process illustrated may be made by those skilled in the technology without departing from the spirit of the invention. The scope of the invention is indicated by the appended claims rather than by the foregoing description. All changes which come within the meaning and range of equivalency of the claims are to be embraced within their scope.

What is claimed is:

1. An inductor comprising:

a drum core comprising a sintered magnetic material and having a winding axis and a pair of collars in a plate shape provided on both ends of the winding axis; and a coil conductor wound on the winding axis of the drum core, the coil conductor being covered on an outer periphery thereof with a composite magnetic material in a sheet form comprising a resin and magnetic powder, the composite magnetic material in a sheet form being adhered to the outer periphery of the coil conductor, wherein there is no substantial region of contact between the composite magnetic material and inner surfaces of the pair of collars of the drum core facing each other.

2. The inductor of claim 1, wherein the inductor further comprises an adhesive layer on one of major surfaces of the composite magnetic material in a sheet form, and the composite magnetic material in a sheet form is adhered to the outer periphery of the coil conductor by the adhesive layer.

3. The inductor of claim 1, wherein the adhesive layer and the composite magnetic material in a sheet form are of the same width.

4. The inductor of claim 1, wherein the adhesive layer is narrower than the composite magnetic material in a sheet form.

5. The inductor of claim 1, wherein the composite magnetic material has no direct contact with the collars.

6. The inductor of claim 1, wherein the composite magnetic material is in direct contact with the collars, and wherein the adhesive layer is in no direct contact with the collars.

7. An inductor comprising:

a drum core comprising magnetic material and having a winding axis and a pair of collars in a plate shape provided on both ends of the winding axis; and a coil conductor wound on the winding axis of the drum core, the coil conductor being covered on an outer periphery thereof with a composite magnetic material comprising a resin and magnetic powder, the composite magnetic material being in direct contact with the outer periphery of the coil conductor, wherein there is no substantial region of contact between the composite magnetic material and the collars.

* * * * *

UNITED STATES PATENT AND TRADEMARK OFFICE

CERTIFICATE OF CORRECTION

PATENT NO. : 7,495,538 B2
APPLICATION NO. : 11/843567
DATED : February 24, 2009
INVENTOR(S) : Tsunemi et al.

It is certified that error appears in the above-identified patent and that said Letters Patent is hereby corrected as shown below:

At Column 6, Line 18, please delete "110°C." and insert therefore, --10°C.--

Signed and Sealed this

Fourth Day of August, 2009

JOHN DOLL
*Acting Director of the United States Patent and Trademark Office*